United States Patent [19]

Hurd

[11] Patent Number: 4,874,046

[45] Date of Patent: Oct. 17, 1989

[54] GROOVE CUTTER FOR CONCRETE BORES

[76] Inventor: Marvin G. Hurd, 105 Field St., Lakewood, Colo. 80226

[21] Appl. No.: 177,357

[22] Filed: Apr. 1, 1988

[51] Int. Cl.[4] ..... E21B 10/32

[52] U.S. Cl. ..... 175/292; 51/332; 299/41; 405/237; 408/80; 408/180; 408/187

[58] Field of Search ..... 175/202, 263, 264, 274, 175/291, 292; 299/41, 80; 405/237, 238; 82/1.2, 1.5; 408/80, 82, 83, 180, 187, 188; 51/331, 332

[56] References Cited

U.S. PATENT DOCUMENTS

| | | | |
|---|---|---|---|
| 1,414,840 | 5/1922 | Terrell | 175/292 X |
| 1,739,956 | 12/1929 | Emerson | 51/331 |
| 2,879,038 | 3/1959 | Johnson | 175/292 X |
| 3,690,357 | 9/1972 | Lugo | 408/187 X |
| 4,497,383 | 2/1985 | Ostertag | 175/202 |

FOREIGN PATENT DOCUMENTS

| | | | |
|---|---|---|---|
| 1752327 | 8/1971 | Fed. Rep. of Germany | 51/331 |

*Primary Examiner*—Stephen J. Novosad
*Assistant Examiner*—David J. Bagnell
*Attorney, Agent, or Firm*—Edwin L. Spangler, Jr.; Richard W. Hanes

[57] ABSTRACT

The invention relates to improvements in rotary groove-cutting tools of the type having a rotatable center shaft and two or more generally arcuate flyweight subassemblies mounted for rotational movement with the center shaft, each such subassembly when thus rotated being also mounted for pivotally-hinged door-like movement between a retracted inoperative position and an extended operative one in contact with the wall of the bore to be grooved about eccentrically-located axes paralleling the center shaft but displaced radially therefrom, such improvements relating to the design and placement of the abrasive-surfaced cutters carried by each of the flyweight subassemblies which especially adapts them for use in grooving concrete bores. More specifically, the invention encompasses such cutters which are circumferentially elongate to an angular extent in which they are adapted to bridge most voids in the bore wall without jamming. In addition, two or more of these cutters are provided on each of the flyweight subassemblies arranged in vertically-stacked but circumferentially staggered relationship while remaining substantially overlapped.

5 Claims, 2 Drawing Sheets

GROOVE CUTTER FOR CONCRETE BORES

BACKGROUND OF THE INVENTION

Not infrequently, a problem arises in connection with attempts at anchoring towers, large machine tools and other structures in concrete footings or slabs. Conventional practice is to bore a cylindrical hole, place the item to be anchored in the hole thus formed and pour fresh concrete back into the hole to form the anchor. Unfortunately, such anchors rely primarily on the weight of the anchor and whatever bond can be established between the anchor and the cylinder wall. Some shrinkage in the size of the anchor is bound to take place which further lessens its ability to adhere to the adjacent bore wall. A much better anchor could be made if the wall of the bore could be grooved circumferentially such that ribs of wet concrete would form around the plug which, once set, would hold it in place.

While the prior art is replete with reamers, boring tools, groove cutters and the like which are used for such things as cutting off pipe downhole, smoothing the sides of machined surfaces, honing away ribs at the top of a cylinder in the block of an internal combustion engine and other similar applications, these tools are ill-suited to the task of reaming grooves in concrete bores. One of the main problems encountered in the latter application is the fact that not infrequently one encounters large voids in the bore wall which cause the ordinary groove-cutting tool to jam. Another factor is, of course, the hostile environment in which the tool works in terms of dust, grit, sand, abrasive cuttings, chunks of rock and whatever else might lie in the wall of the bore or just outside it.

1. Field of the Invention

The present invention relates, therefore, to rotary tools for cutting grooves in the walls of concrete bores.

2. Description of the Related Art

Probably the basic tool for use in cylindrical bores is the reamer or hone. Good examples of such tools are found in the U.S. Patents to Heon Nos. 1,550,807 and 1,774,711; Emerson No. 1,742,466 and Klumpp No. 2,778,167. Of a similar nature is the Solbrig U.S. Pat. No. 2,229,314 which instead of honing or otherwise dressing the entire bore, is designed for use as a ridge-removal tool when reboring internal combustion engine cylinders. These reamers are not at all suited for use in hostile environments like concrete bores nor do they cut grooves in the bore wall.

Next, one encounters a number of inside pipe cutters like, for example, the U.S. Patents to Braswell No. 3,283,405; Wright et al No. 3,739,666; Thompson No. 4,389,765 and Montiero No. 4,524,511. The cutter wheels and eccentrically-mounted cutter heads in these patents all appear to produce narrow saw-like cuts which are not suitable for grooving concrete bores to receive integrally-formed ribs bordering a cast-in-place concrete anchor or plug.

As one might expect, there are also groove cutters for cutting circumferential grooves in the walls of hollow cylindrical elements. While the under-reamer forming the subject matter of Johnson's U.S. Pat. No. 2,879,038 includes a pair of eccentrically-mounted cutters spring-biased into retracted position, nevertheless, these cutters are spaced apart circumferentially 180° and, therefore, would "hang-up" in a void found in the bore wall. The cutters ih Berruyer et al's U.S. Pat. No. 3,389,620 are only spaced apart 120° but they suffer from the same inability to bridge a gap without hanging up. Also, they move radially not on eccentric spring-biased "fly-away" mounts. The Ronaldson et al Pat. No. 2,966,766 is more of a reamer than it is a bore-groover and it, like the previously mentioned patent to Berruyer et al has its cutters spaced 120° apart at their lines of tangency with the bore. The Kessler et al Pat. No. 4,444,279 is most certainly a bore-grooving tool, however, the way in which the cutters are moved radially out against the bore wall using a wedge principal is entirely different from that used by applicant.

From the above it can be seen that the basic concept of mounting the cutters on eccentrically-mounted flyweights which swing out against the bore wall is old in the art as is the use of springs to bring the flyweights back in again so that the tool can be removed. None of these tools, however, shows stacked overlapping cutter subassemblies that extend circumferentially around a substantial portion of the bore and, in addition, overlap one another in staggered relation such that at least one such cutter in each flyaway subassembly will be seated in its groove and be in position to prevent the one or more of the other cutters in the same subassembly from hanging up at the edge of a void. Moreover, these prior art patents are deficient in sealing the moving parts of the system from the abrasive action of the cuttings and the otherwise hostile environment in which the tool is used.

SUMMARY OF THE INVENTION

The present invention relates to an improved rotatable groove cutter of the type including eccentrically-mounted flyweights carrying the cutters that is ideally suited for use in grooving cylindrical bores in concrete. The improvement comprises elongating the cutters circumferentially such that they subtend a substantial portion of the surface of the bore while, at the same time, stacking at least two of these cutters in each of the flyweights in circumferentially staggered relation such that if one of these cutters enters a void where it would otherwise hang up, another of these cutters riding in its groove will support the one in the void and thus prevent the tool from jamming.

It is, therefore, the principal object of the present invention to provide a novel and improved tool for grooving cylindrical concrete bores.

Another objective of the invention herein disclosed and claimed is that of providing a boring tool wherein the moving parts are sealed and protected from the abrasive action of the cuttings.

An additional object is to provide a tool of the class described wherein the elongation together with the stacking and staggering of the cutters enables the flyweight subassemblies to skip over voids without jamming.

Further objects are to provide a concrete bore grooving tool which is simple, easy to operate, rugged, versatile, compact and even somewhat decorative.

Other objects will be in part apparent and in part pointed out specifically hereinafter in connection with the description of the drawings which follows.

DESCRIPTION OF THE PREFERRED EMBODIMENTS

Figure 1:
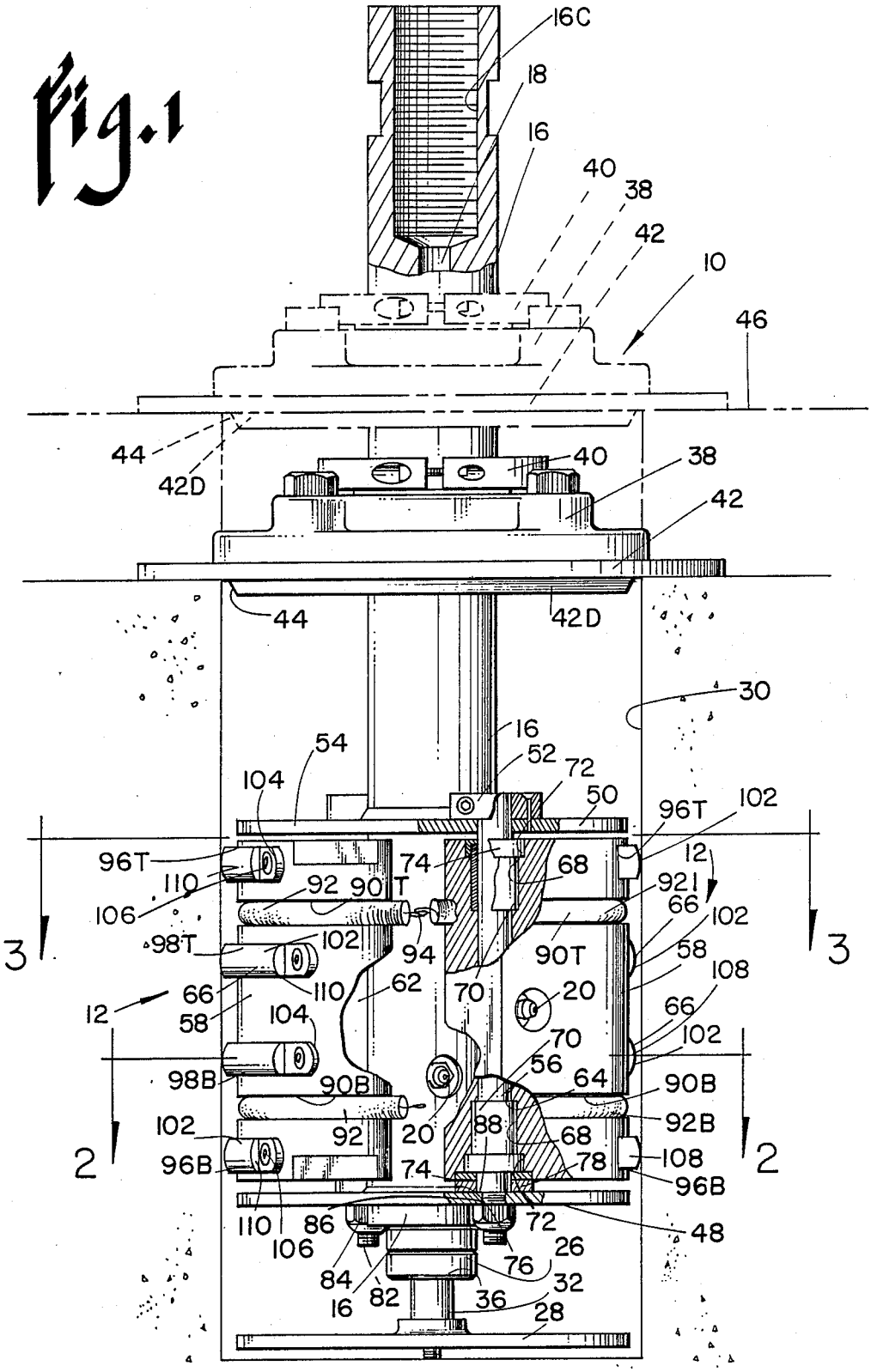
FIG. 1 is an elevational view, portions of which have been broken away and revealed in section, showing the grooving tool in place within a concrete bore.

Referring next to the drawings for a detailed description of the present invention and, initially, to FIG. 1 for this purpose, reference numeral 10 has been chosen to broadly designate the grooving tool in its entirety while reference numeral 12 similarly designates the flyweight subassemblies which carry the cutters. A main drive shaft 16 extends axially through the tool and includes an internally-threaded female coupling 16C on its upper end adapted to receive a motor shaft (not shown) for rotating the tool. The shaft preferably has an axial bore 18 therethrough by means of which it can be lubricated through grease fitting 20. Bore 18 is enlarged adjacent the lower end of shaft 16 as seen at 22 where it is counterbored to provide a downwardly-facing shoulder 24 against which a stack of sealed roller bearings 26 seat as shown. A baseplate 28 rests on the bottom of the bore 30 and supported thereon is a stubshaft 32. This stubshaft has a section 34 of reduced diameter terminating at its lower end in an upwardly-facing annular shoulder 36. The bearing stack 26 sits atop the latter shoulder on reduced section 34 thus journalling main drive shaft 16 for rotation atop the stubshaft and baseplate.

A pillow block 38 journals shaft 16 for rotation. A split ring collar 40 encircles the shaft above the pillow block and supports it atop the latter. The pillow block is bolted to a centrally-apertured support plate 42 which is of greater diameter than the bore 30. On the underside of this support plate formed integral therewith is a disk 42D of lesser diameter sized to enter and center the tool within the bore. In the particular form shown, this disk has a beveled edge 44 to aid in centering the latter. Support plate 42 rests atop the horizontal surface 46 of the footing or slab containing the bore.

Figure 5:
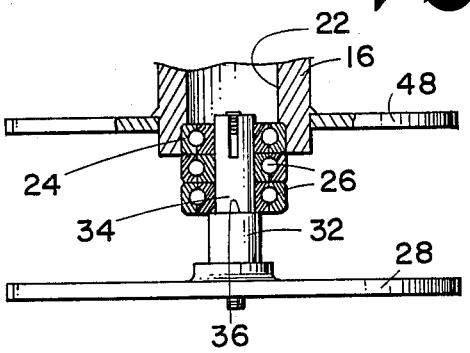

Welded or otherwise attached to the lower end of shaft 16 is an annular flange 48 which provides the support for the flyweight subassemblies 12 as seen best in FIG. 5. This flange 48 together with upper flange 50 which sits atop the flyweight subassemblies turn with the shaft 16, whereas, pillow block 48 and tool-support plate 28 are stationary, the latter plate having a central opening therein (not shown) within which this shaft is journalled for rotation. A second split collar 52 encircles the main shaft 16 and a centrally-apertured disk 54 is bolted or otherwise detachably secured to its underside so that the tool can be disassembled for repair and maintenance. Flange 50 and disk 54 cooperate to define the vertically-spaced supports for flyweight pins 56 upon which the flyweight subassemblies 12 are eccentrically-mounted for swinging movement between the retracted full line positions in which they are shown in FIGS. 2 and 3 and their extended operative positions in which they can be seen in FIG. 1 in full lines and in FIG. 3 in phantom lines.

Figure 2:
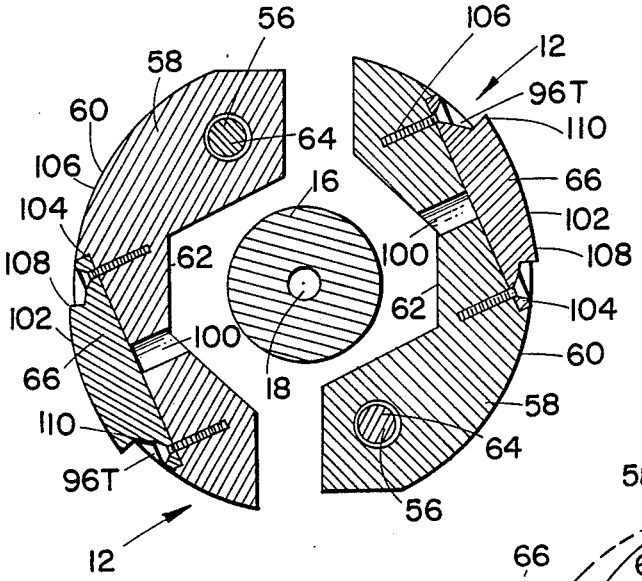
FIG. 2 is a section taken along line 2—2 of FIG. 1.
Figure 3:
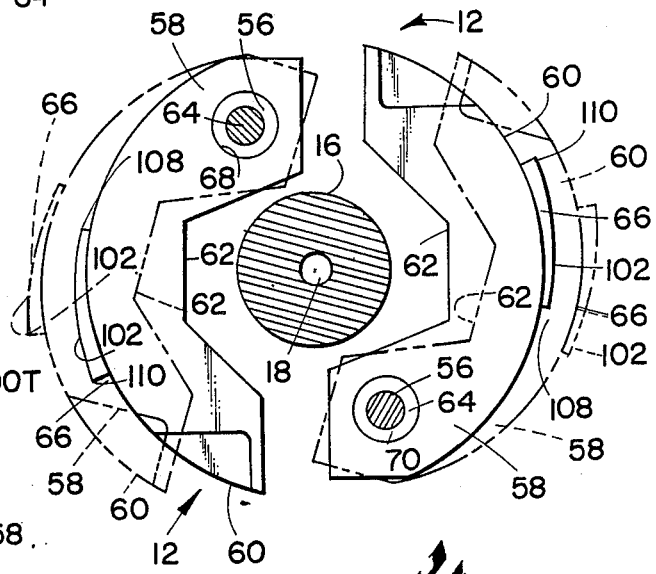
FIG. 3 is a section taken along line 3—3 of FIG. 1.

Directing attention next to FIGS. 1–4 of the drawings, each of the two flyweight subassemblies 12 will be seen to comprise a heavy metal flyweight 58 having a generally semi-cylindrical outer surface 60 and a longitudinally-grooved inner one 62 designed to accommodate the main drive shaft 16 when in retracted position as seen in FIGS. 2 and 3. FIG. 1 shows that each of the two flyweights 58 contains a bore 64 at one end thereof which loosely receives its flyweight pin 56. These bores parallel the axis of the main shaft 16 in diametrically-spaced relation on opposite sides of the latter with each of the flyweights curling around the main shaft in counterclockwise relation as shown in FIGS. 2 and 3. Upon clockwise rotation of the main drive shaft, these flyweights will, of course, pivot around their eccentric pivots defined by flyweight pins 56 and move into the extended phantom-line position in which they are shown in FIG. 3 thus bringing the cutters 66 into contact with the bore 30 in the manner shown in FIG. 1.

Figure 4:
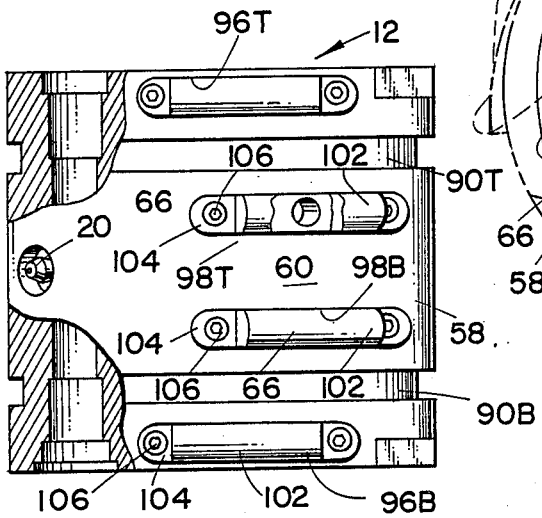
FIG. 4 is a fragmentary detail showing one of the flyweight subassemblies, portions of which have been broken away and shown in section; and, FIG. 5 is a fragmentary detail showing the sealed shaft bearing subassembly at the base of the tool.

The extremities of the bores 64 are enlarged as shown at 68 to, first of all, except oil-impregnated bushings 70 which define journals on both the upper and lower ends thereof and, in addition, further enlarged as seen at 72 to receive dust caps 74 which keep dust and cuttings from reaching the bushings. Yet another enlargement 76 defines a downwardly-facing annular shoulder 78 against which one or more washers 80 seat in supporting relation to the entire flyweight subassembly 12 for movement between its retracted and extended operative positions shown in FIG. 3. The lower end of each pin 56 is reduced in diameter and threaded as seen at 82. It is then secured underneath support plate 48 by means of nuts 84 which cooperate with collar 40 on the upper end of shaft 16 to keep the latter from moving axially. This support plate is provided with apertures 86 sized to receive the threaded section 82 of pin 56. Above this threaded section is a downwardly-facing annular shoulder 88 which rests atop plate 48. Pins 56 are lubricated through other conventional grease fittings 20 positioned as shown in FIGS. 1 and 4. The resulting pivotal mounting of the flyweight subassemblies is essentially sealed against the entry of abrasive dust and grit from the cuttings which is very important considering the hostile environment in which the tool operates.

Again with specific reference to FIG. 1, it can be seen that each of the two flyweights 58 includes a pair of circumferential grooves 90T and 90B which are aligned with one another and receive long tension springs 92 which encircle the entire unit and have their free ends 94 connected as shown. These springs normally bias the flyweight subassemblies into their retracted positions so that the tool can be removed from the bore 30. Upon rotation, on the other hand, these springs yield under the centrifugal forces tending to throw the flyweight subassemblies outwardly into their extended operative positions against the cylindrical wall of the bore. Two such springs are shown, one, 92T, being spaced down from the top of the flyweight subassemblies and the second, 92B, similarly spaced up from the bottom.

In addition to circumferential spring-receiving grooves 90, each of the flyweights 58 has its outer cylindrical surface provided with a plurality of circumferentially-extending elongate recesses 96T, 96B, 98T and 98B for receiving the cutters 66 which are most clearly revealed in FIGS. 2 and 4. In the particular form shown, there are two sets or pairs of these sockets or recesses which are arranged, as are the cutters 66 mounted therein, in circumferentially offset, yet overlapped, relation to one another. The elements of each pair, 96 and 98, on the other hand, are vertically aligned but spaced apart. As shown, the widespread pair 96T and 96B are located above and below the tension springs 92T and 92B, respectively; whereas, the closely-spaced pair 98T and 98B lie between the latter. A passage 100 seen only in FIG. 2 connects the longitudinally extending groove 62 on the inside of the flyweight 58 with each of the cutter-receiving recesses 96 and 98. The cutters fit rather snugly in their recesses and they can, therefore, become difficult to remove from the outside especially if they have become worn and their recesses clogged with dust. By being able to access the backside of these cutters from the inside of the flyweights through these passages, removal of the cutters becomes quite a simple operation.

As illustrated, all of the cutters 66 are identical and they include an abrasive cutting surface 102 bordered on both ends by recessed ears 104 formed integrally therewith and which are apertured to receive the bolts 106 which detachably fasten them to the flyweights. Surfaces 102 are preferably coated with diamond dust or some other abrasive compound capable of cutting concrete although toothed cutters could also be used.

The shape of these cutting surfaces is such that they are convex when viewed endwise as seen in FIG. 1 while being generally cylindrical when seen from the top or bottom as shown in FIGS. 2 and 3. It is important to note, however, that while essentially cylindrical circumferentially, they are not cylindrical about the axis of tool rotation defined by drive shaft 16, but rather, an axis offset to the side of the latter remote from that about which the flyweight pivots thus placing the leading edge 108 thereof closer to the axis of tool rotation than the trailing edge 110. Looking at this another way, the leading edges 108 of the cutters are positioned closer to the axis of pivotal movement of the flyweight defined by pins 56 than the trailing edges 110 thereof. As such, those portions of the cutting surfaces 102 adjacent the trailing edges 110 start a very shallow groove in the bore upon clockwise rotation of the tool as seen in FIGS. 2 and 3 followed immediately by a steadily increasing penetration as more and more of these cutting surfaces come into contact with the bore wall. The convexity of these cutting surfaces, of course, produces a round-bottomed groove in the bore.

The principal novelty in the present groove-cutting tool resides, first of all, in the fact that these cutting surfaces 102 are circumferentially elongated to a degree where they will generally bridge a void of several inches all by themselves. Secondly, by stacking several such cutting surfaces one above the other, if the tool encounters a void, more than likely one of the other cutting surfaces is not aligned therewith and it can, therefore, support the entire flyweight subassembly and prevent the one that is positioned to enter the latter from doing so where, otherwise, its leading edge might catch and very possibly cause the tool to jam. In other words, almost certainly, one or more of the cutting surfaces 102 will remain in its groove even if others encounter a void thus keeping the flyweight subassemblies tracking properly.

Dimensionally, in the particular form illustrated, each of the cutting surfaces 102 subtends an angle of approximately 35°. A more meaningful measurement is, perhaps, to note that in a bore of a little over six inches in diameter, each cutting surface will bridge about a two inch void. Moreover, by circumferentially offsetting the pairs of cutters while, at the same time leaving them in overlapped relationship, the angle subtended by the cutters in each flyweight subassembly is increased to just slightly less than 60° or almost a sixth of the circumference of the bore. Accordingly, if, say, adjacent cutters 96B and 98B happened to enter the same void, their combined lengths will allow them to bridge one of nearly three inches in angular extent assuming a bore of between six and seven inches in diameter. The same would be true, of course, of offset cutters 96T and 98T at the top of the tool. Seldom will the void extend vertically the some five inches it would have to do to encompass all of the cutters. Moreover, even if it did, the chances are that it would narrow at either the top or bottom to a dimension where a single cutting surface could bridge same or, alternatively, two such surfaces located adjacent one another and circumferentially offset to lengthen their overall bridging capability could do so. Applicant has found that without these features in a grooving tool for grooving concrete bores, it just won't perform satisfactorily even though the tools of the prior art would do so in other environments which are less hostile and more uniform.

Finally, with reference to FIGS. 1 and 3, it can be seen that as the tool enters the bore 30, the cutting surfaces 102 already lie in close proximity to its cylindrical surface. Then, as the tool begins to rotate, the flyweight subassemblies simultaneously fly out about their eccentric pivots 56 thus placing a portion near the trailing edge 110 in contact therewith. As the grooves deepen, more and more of each cutter will enter same and become active. In time, of course, the flyweight subassemblies will be fully extended and the cylindrical surfaces 60 of the flyweights themselves will be rubbing against the bore, whereupon, no further deepening of the grooves can take place. At this point, the machine will be stopped permitting the springs to retract the flyweight subassemblies from the grooves their cutters have dug and enabling the tool to be lifted from the bore suitably grooved to receive a cast-in-place anchor.

What is claimed is:

1. In a rotary groove-cutting tool of the type having a rotatable center shaft and two or more generally-arcuate flyweight subassemblies mounted for rotational movement with said center shaft, said subassemblies each being mounted for pivotal movement between a retracted inoperative position when at rest and an extended operative one upon being rotated, and in which said flyweight subassemblies in extended position swing out toward the bore wall about eccentrically-located axes paralleling the center shaft but displaced radially therefrom, the improvement comprising a means carried by said flyweight subassemblies especially adapted for cutting circumferential grooves in concrete bores likely to have voids therein, which comprises: at least two circumferentially elongate cutters having outwardly-facing abrasive cutting surfaces arranged one above the other in vertically-spaced stacked relation for cutting separate grooves, said cutters being circumferentially staggered while having portions thereof overlapped.

2. The improved concrete-grooving means for rotary groove-cutting tools as set forth in claim 1 wherein: the combined overlapped lengths of the cutters exceeds the length of each individually by at least approximately one-third.

3. The improved concrete-grooving means for rotary groove-cutting tools as set forth in claim 1 wherein: at least two stacked pairs of cutters are provided on each flyweight subassembly, the cutters of each pair being circumferentially staggered relative to the other cutter of the same pair, and the cutters of one of the two pairs being substantially vertically aligned with the corresponding cutter of the other of the two pairs.

4. The improved concrete-grooving means for rotary groove-cutting tools as set forth in claim 3 wherein: the abrasive cutting surfaces of each cutter are circumferentially arcuate, said surfaces having a leading edge and a trailing edge, the leading edge leading in the direction of tool rotation, and in which said abrasive surfaces steadily approach the bore wall more closely from the leading edge to the trailing edge thereof in both the retracted and extended positions of the flyweight subassemblies.

5. The improved concrete-grooving means for rotary groove-cutting tools as set forth in claim 4 wherein: the abrasive cutting surfaces are cylindrical about an axis paralleling the axis of tool rotation but spaced therefrom on the opposite side of the latter from the axis of flyweight pivotal movement.

* * * * *